US008203270B2

(12) United States Patent
Ohkahara et al.

(10) Patent No.: US 8,203,270 B2
(45) Date of Patent: Jun. 19, 2012

(54) LIGHT SOURCE DEVICE

(75) Inventors: Makoto Ohkahara, Saitama (JP); Yosuke Kano, Saitama (JP)

(73) Assignee: Iwasaki Electric Co., Ltd., Tokyo (JP)

( * ) Notice: Subject to any disclaimer, the term of this patent is extended or adjusted under 35 U.S.C. 154(b) by 0 days.

(21) Appl. No.: 13/258,081

(22) PCT Filed: Apr. 6, 2010

(86) PCT No.: PCT/JP2010/056232

§ 371 (c)(1),
(2), (4) Date: Oct. 24, 2011

(87) PCT Pub. No.: WO2010/119793

PCT Pub. Date: Oct. 21, 2010

(65) Prior Publication Data

US 2012/0025688 A1 Feb. 2, 2012

(30) Foreign Application Priority Data

Apr. 17, 2009 (JP) ..... 2009-100768

(51) Int. Cl.
*H01J 17/16* (2012.01)
*H01J 61/30* (2006.01)

(52) U.S. Cl. ..... 313/636; 313/113; 313/493; 313/634; 313/607; 313/318.08

(58) Field of Classification Search ..... 313/484, 313/113, 493, 567, 571, 576, 594, 601, 607, 313/623–625, 634, 636, 637–643, 318.01, 313/318.02, 318.08
See application file for complete search history.

(56) References Cited

U.S. PATENT DOCUMENTS

| | | | | |
|---|---|---|---|---|
| 2004/0095069 | A1 | 5/2004 | Yamashita et al. | |
| 2009/0224667 | A1 * | 9/2009 | Fujii et al. | 313/567 |
| 2010/0207504 | A1 * | 8/2010 | Kassenaar et al. | 313/113 |
| 2010/0295448 | A1 * | 11/2010 | Takagaki et al. | 313/623 |
| 2010/0327727 | A1 * | 12/2010 | Flesch | 313/113 |

FOREIGN PATENT DOCUMENTS

| | | |
|---|---|---|
| JP | 11-513182 | 11/1999 |
| JP | 2002-100323 | 4/2002 |
| JP | 2004-139955 | 5/2004 |
| JP | 3137961 | 12/2007 |
| JP | 4112638 | 7/2008 |

OTHER PUBLICATIONS

U.S. Appl. No. 13/319,736 to Yosuke Kano et al., filed Nov. 10, 2011.

* cited by examiner

*Primary Examiner* — Toan Ton
*Assistant Examiner* — Kevin Quarterman
(74) *Attorney, Agent, or Firm* — Greenblum & Bernstein P.L.C.

(57) ABSTRACT

A start assisting light source is configured such that it can be mounted simply and reliably at a position capable of efficiently radiating UV-light for enhancing the starting performance of a high pressure discharge lamp to discharge chamber without being heated to a high temperature during lighting of the lamp and also adopted to a simple constitution of not increasing the manufacturing cost. A start assisting light source includes an airtight vessel filled with a rare gas and a pipe member that penetrates through the vessel is mounted to an electrode lead which protrudes from the end face of an electrode seal portion secured to a bottom hole of the concave reflector by inserting the electrode lead through the pipe member.

14 Claims, 9 Drawing Sheets

LIGHT SOURCE DEVICE

TECHNICAL FIELD

The present invention concerns a light source device used, for example, in liquid crystal projectors and DLP projectors.

BACKGROUND ART

In light source devices for liquid crystal projectors and DLP projectors which are required to be reduced in size and can provide bright projection images, short arc type high pressure mercury vapor discharge lamps which are small in size and can provide light emission at high brightness have been used and, since the lamps of this type involve a problem that starting performance under cold condition and restarting performance under hot restrike condition is not generally preferred, start assisting light sources are provided to enhance the starting performance.

An existent light source device shown in FIG. 7 includes: a high pressure discharge lamp 51 of short arc type in which a discharge chamber 54 having a pair of tungsten electrodes 56, 56 opposed each other at a short inter-electrode distance of about 1 mm and mercury, halogen, e.g., bromine and a starting gas such as an argon gas filled therein is formed in the center of an arc tube 52 formed of a quartz glass tube, a pair of electrode seal portions 59R, 59L each having the electrode 56, a metal foil 57, and an electrode lead 58 sealed therein are formed from the discharge chamber 54 to both ends of the arc tube 52, and connected to a lighting circuit by way of the electrode leads 58, 58 protruding from the end faces of the electrode seal portions 59R, 59L, a concave reflector 61 to which the electrode seal portion 59L on one side of the lamp 51 is secured by being inserted through a bottom hole 62 opened in the bottom of the reflector, and an ignition antenna 63 as a start assisting light source that radiates UV-light to the discharge chamber 54 for enhancing the starting performance of the lamp 51 upon startup lighting thereof (refer to Patent document 1).

As shown in an enlarged view of FIG. 8(*a*) and in a cross sectional view along X-X of FIG. 8(*b*), the ignition antenna 63 has an antenna vessel 64 formed of a quartz glass tube comprising a long straight tube portion 65*a* that extends as far as the proximity of the discharge chamber 54 of the lamp 51 along the electrode seal portion 59L and a bent tube portion 65*b* that is provided to the top end of the tube portion 65*a* and bent in a semi-arcuate shape so as to be wound by 180° around the outer periphery of the electrode seal portion 59L. Mercury and an argon gas as ionizing filler are filled in the vessel, an electric conductor element 66 comprising a metal foil (molybdenum foil) is contained and disposed on the side of the free end of the straight tube portion 65*a* of the antenna vessel 64, and an outer electrode 67 comprising a metal bush is fitted on the side of the free end of the straight tube portion 65*a*.

Then, the ignition antenna 63 is secured at the outer electrode 67 to the outer periphery of the electrode seal portion 59L with cement 68, the outer electrode 67 is connected by way of a current supply conductor 69 to the output of voltage transforming means 71 connected between current conductors 70R, 70L that constitute the lighting circuit of the high pressure discharge lamp 51. When a starting voltage such as a high frequency AC voltage or pulse voltage is applied between the outer electrode 67 and the electric conductor element 66 in the antenna vessel 64, electric discharge is caused between them to generate UV-light, and the UV-light is radiated through the straight tube portion 65*a* and the bent tube portion 65*b* into the discharge chamber 54 of the lamp 51 thereby promoting arc discharge between the electrodes 56 and 56.

However, it is laborious to manufacture the antenna vessel 64 comprising the straight tube portion 65*a* and the bent tube portion 65*b* contiguous to each other and this results in a drawback of increasing the manufacturing cost. Further, since the bent tube portion 65*b* of the antenna vessel 64 is in proximity to the discharge chamber 54 of the lamp 51 which is heated to a high temperature of about 1000° C. upon lighting of the lamp, this results in a problem that discharge between the outer electrode 67 and the electric conductor element 66 is instable due to the effect of the high temperature just after turning off the lamp to deteriorate the restarting performance under hot conditions and, at the same time, the antenna vessel 64 may be possibly fractured while undergoing thermal damages.

Further, there is also a disadvantage that UV-light generated by the electric discharge between the outer electrode 67 and the electric conductor element 66 is attenuated by reflection, diffraction, or absorption to the filler in the antenna vessel 64 in a process where the UV-light is guided through the long straight tube portion 65*a* and the bent tube portion 65*b* of the antenna vessel 64 to the inside of the discharge chamber 54 of the lamp 51. Further, since the bent tube portion 65*b* of the antenna vessel 64 is disposed in proximity to one side of the discharge chamber 54 of the lamp 51, the temperature distribution during lighting of the lamp is significantly different between one side and the other side of the discharge chamber 54, to possibly deteriorate the lamp working life. At the same time, it also results in a disadvantage that the bent tube portion 65*b* of the antenna vessel 64 interrupts a portion of light radiated from the discharge chamber 54 of the lamp 51 to the bottom of the concave reflector 61, thereby lowering the efficiency of utilizing the light of the lamp. Further, there may be also a possibility that the ignition antenna 63 is detached from the outer periphery of the electrode seal portion 59L due to aging deterioration (thermal deterioration) of the cement 68 that secures the ignition antenna 63 to the electrode seal portion 59L.

Then, the present applicant proposed a light source device as shown in FIG. 9 in which a glow discharge tube 80 that generates UV-light upon startup lighting of the high pressure discharge lamp 51 is disposed at a position capable of radiating UV-light to the discharge chamber 54 of the lamp 51 from the outside of a concave reflector 81 through a vent hole 82 for cooling air formed in the reflector (refer to Patent Document 2).

In the light source device in FIG. 9, since the high pressure discharge lamp 51 having a basic structure identical with that of the high pressure discharge lamp in FIG. 7 is inserted at an electrode seal portion 59L on one side thereof through a bottom hole 83 opened in the bottom of a reflector 81 and mounted integrally to the reflector 81, and a glow discharge lamp 80 as a start assisting light source radiates UV-light for enhancing the starting performance to the discharge chamber 54 upon startup lighting of the lamp 51 is disposed outside of the reflector 81, the mercury vapor pressure inside the discharge tube 80 is not increased excessively even when heated to a high temperature upon lighting of lamp and can cause glow discharge to generate UV-light also under hot conditions just after turning off of lamp.

Further, since the glow discharge tube 80 has a simple structure of sealing a rare gas such as an argon gas containing mercury vapor inside a glass seal tube 84 comprising quartz glass, containing and disposing an inner electrode 85 comprising a metal foil and having a pair of lead wires 86, 86 that protrude from both ends of the glass seal tube 84 and disposing a coiled outer electrode 87 formed by winding a chromium-aluminum iron alloy wire 89 having a diameter of about 0.2 mm around the outer periphery of the glass seal tube 84, it has an advantage that the manufacturing cost is not increased.

The inner electrode 85 and the outer electrode 87 of the glow discharge tube 80 are connected to one side 88R and the other side 88L of a lamp lighting circuit respectively. When a starting high frequency pulse voltage is applied between the inner electrode 85 and the outer electrode 87, glow discharge is caused in the mercury vapor in the glass seal tube 84 as a main body of the discharge tube 80 to generate UV-light, and a portion of the UV-light is radiated directly through the vent hole 82 for cooling air formed in the reflector 81 to the discharge chamber 54 of the lamp 51 disposed inside the reflector 81, or radiated after being reflected at the reflection surface of the reflector 81.

However, when the discharge tube 80 is disposed at a position remote from the vent hole 82 of the reflector 81, the amount of UV-light radiated through the vent hole 82 to the inside of the reflector 81 is decreased to result in a problem of lowering the starting performance of the lamp 51. On the other hand, when the discharge tube 80 is disposed in proximity to the vent hole 82 of the reflector 81, since the vent hole 82 is closed by the discharge tube 80, the flow of the cooling air is hindered to result in a problem of lowering the cooling effect for the lamp 51.

Further, there is also a problem that when the number of turns of the coils of the coiled outer electrode 87 disposed to the outer periphery thereof is insufficient, since the generation amount of UV-light is small, the discharge tube 80 cannot radiate the UV-light in a necessary and sufficient amount to the discharge chamber 54 of the lamp 51. On the other hand, when the number of turns of the coils of the coiled outer electrode 87 is increased, UV-light is interrupted by the outer electrode 87 to result in a problem that the UV-light cannot be radiated in a necessary and sufficient amount to the discharge chamber 54 of the lamp 51.

Then, a high pressure discharge lamp 91 shown in FIG. 10(*a*) is different in view of the type and the structure from the high pressure discharge lamp 51 described above. A discharge chamber 92 and a UV enhancer 93 as a start assisting light source that radiate UV-light to the discharge chamber are contained inside an outer chamber 95 having a lamp cap (base) 94 (refer to Patent Document 3).

In the discharge chamber 92, a pair of opposed inner electrodes 96L and 96R in the inside thereof are connected by way of power feeder wires 97, 98 to one contact and the other contact of a lamp cap 94 by way of power feeder wires 97, 98 respectively.

As shown in the cross sectional view of FIG. 10(*b*), in the UV enhancer 93, a rare gas comprising an argon gas is filled inside a UV-discharge tube 99 having a tube wall formed of a ceramic material comprising sintered polycrystal $Al_2O_3$, and an inner electrode 101 comprising a tungsten rod having a 170 μm diameter welded to the top end of a lead through conductor 100 comprising a niobium rod having a 620 μm diameter sealed on one side of the UV-discharge tube 99 is disposed. Then, the inner electrode 101 is connected by way of the lead through conductor 100 to the power feeder wire 97, and the UV-discharge tube 99 is disposed being supported by the lead through conductor 100 in the proximity to the power feeder wire 98, and capacitively coupled with the power feeder wire 98 to act as a UV-source.

However, the high pressure discharge lamp 91 in FIG. 10(*a*) has a drawback that the UV-enhancer 93 as the start assisting light source interrupts the light radiated from the discharge chamber 92 to lower the light use efficiency, or causes unevenness in the brightness or shadow. Further, since the UV-enhancer 93 has a configuration of supporting one end of the UV-discharge tube 99 comprising the ceramic material by the lead through conductor 100, when an impact exerts from the outside to the high pressure discharge lamp 91, the UV-discharge tube 99 swings greatly by the impact and the lead through conductor 100 is deformed by dynamic load of the discharge tube 99 thereby causing positional displacement of the discharge tube 99 to deteriorate capacitive coupling with the power feeder wire 98 to no more function as the UV-source, or the lead through conductor 100 connected to the power feeder wire 97 may be possibly in contact with the other power feeder wire 98 to result in short circuit accident.

PRIOR ART DOCUMENT

Patent Document

[Patent Document 1] JP No. 4112638
[Patent Document 2] JUM No. 3137961
[Patent Document 3] JP-T H11(1998)-513182

SUMMARY OF THE INVENTION

Subject to be Solved by the Invention

The present invention has a technical subject of enabling the start assisting light source to be mounted simply and reliably at a position capable of efficiently radiating UV-light for enhancing the starting performance of the lamp to a discharge chamber without being heated to a high temperature during lighting of a high pressure discharge lamp and also adopting a simple constitution for the start assisting light source of not increasing the manufacturing cost.

Means for Solving the Subject

For solving the subjects described above, the present invention provides a light source device including;

a high pressure discharge lamp in which a discharge chamber having a pair of electrodes opposed each other and at least mercury and a starting gas filled therein is formed in the center of an arc tube, a pair of electrode seal portions extend from the discharge chamber to both ends of the arc tube, and connected by way of electrode leads extending from end faces of the electrode seal portions to a lighting circuit, a concave reflector to which the lamp is secured by inserting one electrode seal portion thereof through a bottom hole opened in the bottom of the reflector; and a start assisting light source that radiates UV-light to the discharge chamber for enhancing the starting performance of the lamp upon startup lighting of the lamp, wherein the start assisting light source comprising an airtight vessel formed of ceramics and filled with a rare gas and a pipe member penetrating through the vessel is mounted to the electrode lead protruding from the end face of the electrode seal portion secured to the bottom hole of the concave reflector by inserting the electrode lead through the pipe member, and the airtight vessel is formed entirely or at a portion opposing the end face of the electrode seal portion with translucent ceramics.

Effect of the Invention

According to the present invention, since the start assisting light source that radiates UV-light for enhancing the starting performance upon startup lighting of the high pressure discharge lamp to a discharge chamber has a simple constitution comprising an airtight vessel formed of ceramics and filled with a rare gas, and a pipe member penetrating through the vessel, the manufacturing cost is not increased. Further, the start assisting light source of the invention can be mounted simply and reliably to the electrode lead protruding from the end face of the electrode seal portion secured to the bottom hole of the concave reflector by inserting the electrode lead through the pipe member. Further, the start assisting light source mounted to the electrode lead is not heated to a high temperature upon lighting of the high pressure discharge lamp, and UV-light for enhancing the starting performance of the lamp can be radiated efficiently from the end face of the electrode seal portion to the discharge chamber.

MODE FOR CARRYING OUT THE INVENTION

An embodiment of a light source device according to the present invention includes;

a high pressure discharge lamp in which a discharge chamber having a pair of electrodes opposed each other and at least mercury and a starting gas filled therein is formed in the center of an arc tube formed of quartz glass, a pair of electrode seal portions extend from the discharge chamber to both ends of the arc tube, and connected by way of electrode leads formed of molybdenum wires extending from end faces of the electrode seal portions to a lighting circuit, a concave reflector to which the lamp is secured by being inserted at one electrode seal portion thereof through a bottom hole opened in the bottom of the reflector, and a start assisting light source that radiates UV-light to the discharge chamber for enhancing the starting performance of the lamp upon startup lighting of the lamp.

The start assisting light source comprises an airtight vessel formed of ceramics filled with a rare gas such as an argon gas or a rare gas containing mercury vapor and a pipe member penetrating through the center of the vessel in which an electrode lead protruding from the end face of the electrode seal portion secured to the bottom hole of the concave reflector is inserted through the pipe member and the start assisting light source is mounted to the electrode lead.

The airtight vessel constituting the start assisting light source is assembled, for example, by a cylindrical vessel body opened at both ends, a pair of apertured caps for capping openings on both ends of the vessel body, and a pipe member inserted into the apertures of both of the apertured caps, in which a portion opposing the end face of the electrode seal portion when mounted to the electrode lead protruding from the end face of the electrode seal portion is formed of translucent ceramics.

Further, the pipe member penetrating through the center of the airtight vessel is formed of a ceramic pipe or a metal pipe such as a niobium pipe. When the pipe member is formed of the ceramic pipe, a stopper metal for preventing the pipe member from moving in the direction receding from the end face of the electrode seal portion where the electrode lead protrudes is welded to the electrode lead inserted through the pipe member. Further, when the pipe member is formed of the metal pipe, the end of the pipe member is welded to the electrode lead inserted through the pipe member.

EXAMPLE 1

Figure 1:
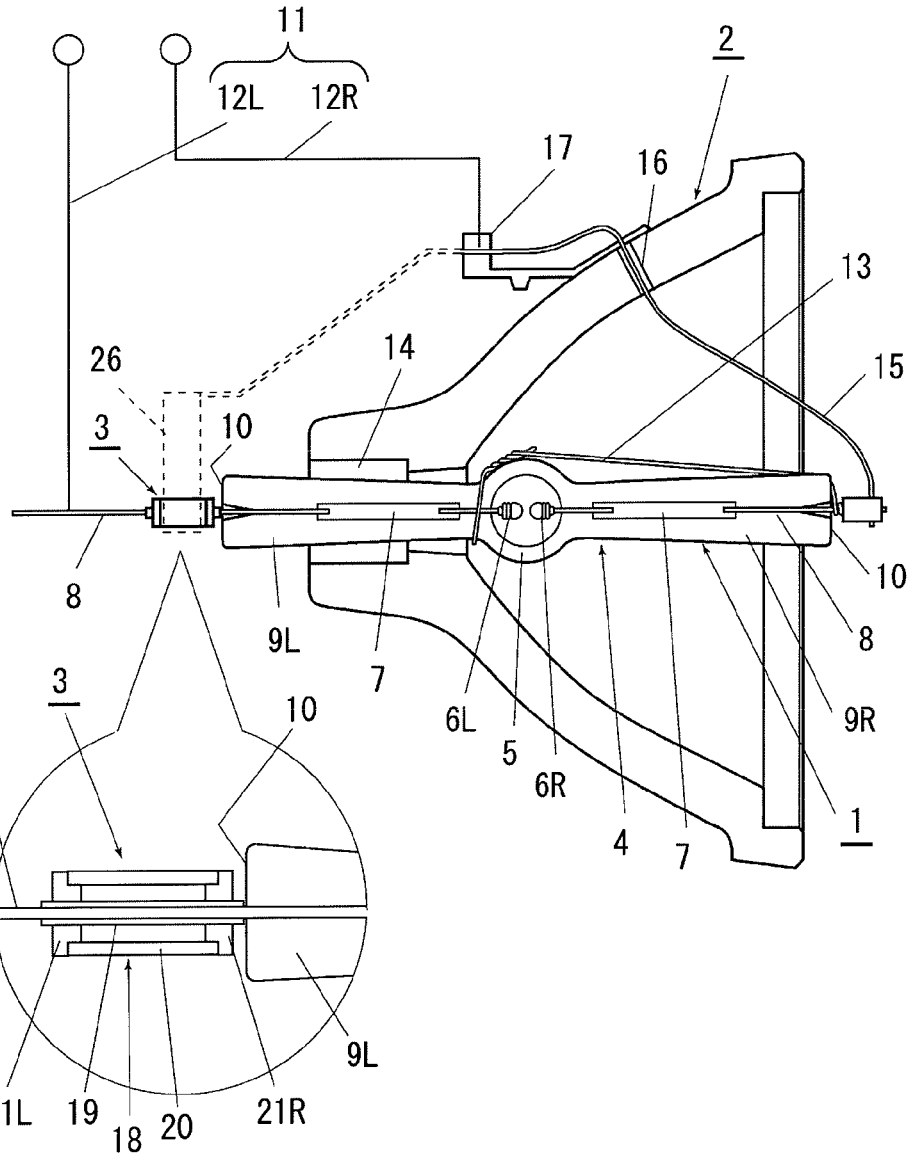
FIG. 1 is a view showing an example of a light source device according to the present invention.
Figure 2:
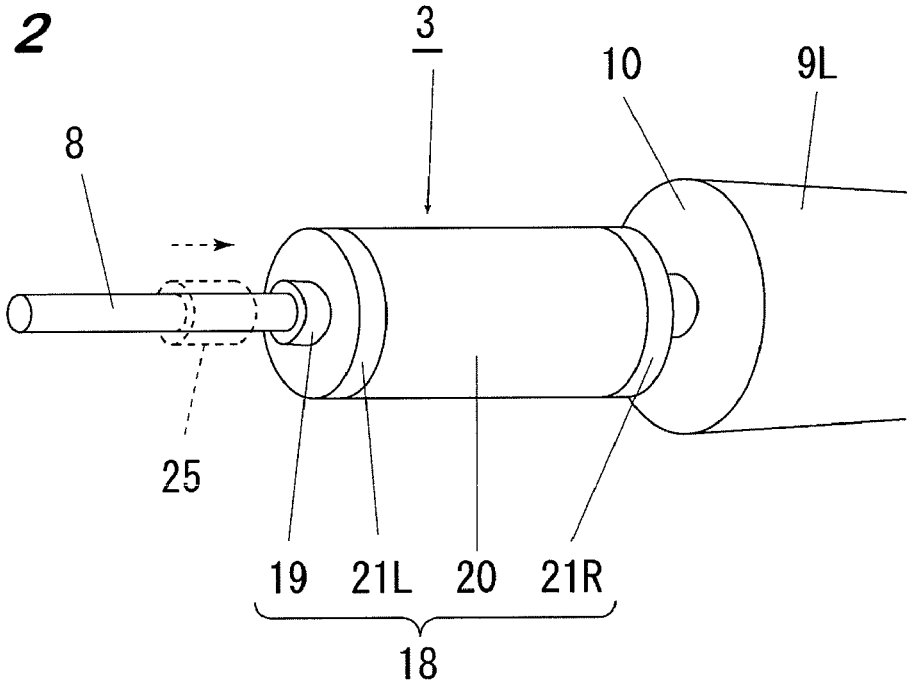
FIG. 2 is a perspective view of a start assisting light source of the light source device in FIG. 1.
Figure 3:
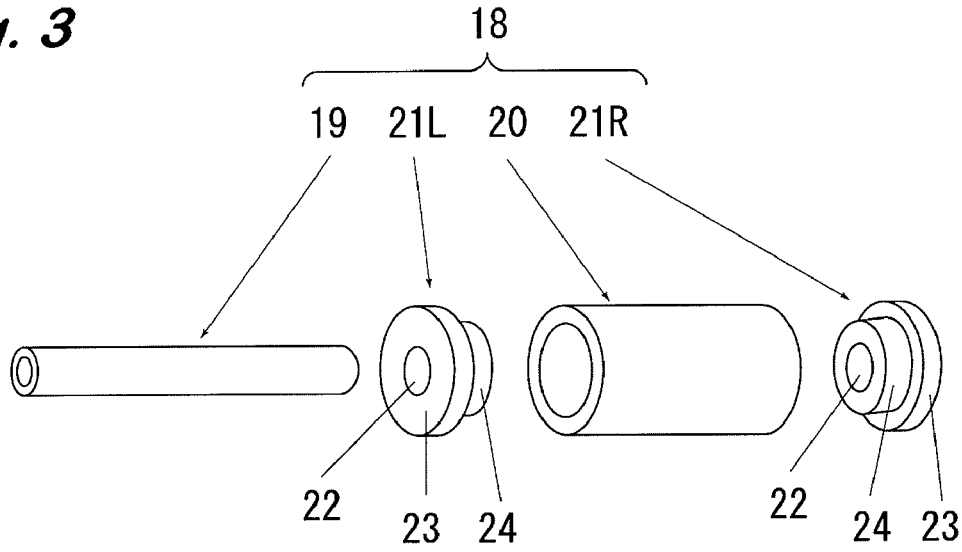
FIG. 3 is an exploded view showing constituent members of the start assisting light source in FIGS. 1 and 2.

FIG. 1 is a view showing an example of a light source device according to the present invention, FIG. 2 is a perspective view of a start assisting light source of the light source device, FIG. 3 is an exploded view showing constitutional components of the start assisting light source. The light source device in FIG. 1 has a high pressure discharge lamp 1, a concave reflector 2 for reflecting the light radiated from the lamp 1, and a start assisting light source 3 generating UV-light for enhancing the starting performance of the lamp 1.

The high pressure discharge lamp 1 comprises a discharge chamber 5 in the center of an arc tube 4 made by quartz glass. In the chamber, a pair of tungsten electrodes 6R, 6L are opposed each other at a short inter-electrode distance of about 1 mm, and mercury, halogen e.g., bromine and a starting gas such as an argon gas are filled. A portion from the discharge chamber 5 to both ends of the arc tube 4 is airtightly sealed, and a pair of electrode seal portions 9R, 9L are formed by sealing each of electrodes 6R, 6L, a metal foil 7 comprising a molybdenum foil connected thereto and an electrode lead 8 comprising a molybdenum wire having a wire diameter of about 1.2 mm.

Then, the electrode leads 8, 8 protruding from the end faces 10, 10 of the electrode seal portions 9R and 9L are connected to one side 12R and the other side 12L of a lighting circuit 11 for supplying lamp power respectively. A metal wire 13 as a trigger wire for promoting arc discharge between the electrodes 6R and 6L is connected at one end thereof to the electrode lead 8 protruding from the end face 10 of the electrode seal portion 9R and wound at the other end thereof in a loop shape around the outer periphery of the electrode seal portion 9L.

In the concave reflector 2, a bottom hole 14 is opened at the bottom for inserting one electrode seal portion 9L of the high pressure discharge lamp 1 and securing the same with cement or the like. A wiring hole 16 is perforated in the reflection portion for inserting a lead wire 15 comprising a nickel wire connected to the electrode lead 8 protruding from the other electrode seal portion 9R of the high pressure discharge lamp 1, and a wiring metal 17 is secured at the back of the reflection portion for securing the lead wire 15 led out from the wiring hole 16.

The start assisting light source 3 comprises an airtight vessel 18 formed of ceramics and filled with an argon gas or an argon gas containing mercury vapor at a pressure of about 5 to 100 torr and a pipe member 19 provided to the vessel 18 while penetrating through the center thereof and is mounted to electrode lead 8 protruding from the end face 10 of the electrode seal portion 9L secured to the bottom hole 14 of the concave reflector 2 by inserting the electrode lead 8 through the pipe member 19.

The airtight vessel 18 constituting the start assisting light source 3 is assembled with a cylindrical vessel body 20 having an outer diameter of about 5.2 mm, an inner diameter of about 4.0 mm, and a length of about 8.0 mm, a pair of apertured caps 21R, 21L for capping openings on both ends of the vessel body 20, and a pipe member 19 fitting into the apertures 22, 22 of both of the apertured caps 21R and 21L.

The apertured caps 21R, 21L have identical shape and size in which a disk-shaped flange member 23 abutting against the opening end of the vessel body 20 is formed to an outer diameter of about 5.2 mm and a thickness of about 1.0 mm, and a cylindrical portion 24 fitted to the opening of the vessel body 20 is formed to an outer diameter of about 3.8 mm and the diameter of the aperture 22 of about 2.2 mm. Further, the pipe member 19 inserted through the apertures 22, 22 of the apertured caps 21R, 21L is formed to an outer diameter of about 2.0 mm, an inner diameter of about 1.4 mm, and a length of about 12 mm. A gap formed between the vessel body 20 and the apertured caps 21R and 21L for capping the openings on both ends and a gap formed between the apertures 22, 22 of the apertured caps 21R, 21L and the pipe member 19 fitting to the apertures are airtightly sealed with glass frits which are filled in the gaps and melted and solidified.

The entire airtight vessel 18 or the vessel body 20 thereof and the apertured cap 21R opposing the end face 10 of the electrode seal portion 9L are formed of translucent alumina ($Al_2O_3$) ceramics at high purity and high density. Further, the pipe member 19 fitted into the apertures 22, 22 of the apertured caps 21R, 21L are formed of a ceramic pipe, or formed of a metal pipe such as a niobium pipe having a thermal expansion coefficient approximate to that of the ceramics forming the airtight vessel 18.

When the pipe member 19 of the start assisting light source 3 comprises the metal pipe, the electrode lead 8 protruding from the end face 10 of the electrode seal portion 9L is inserted through the pipe member 19 and the start assisting light source 3 is disposed in contact with or in proximity to the end face 10 of the electrode seal portion 9L. and, in this state, the end of the pipe member 19 is welded to the electrode lead 8 to secure the start assisting light source 3 to the electrode lead 8.

Further, when the pipe member 19 of the start assisting light source 3 comprises the ceramic pipe, the electrode lead 8 is inserted through the pipe member 19 and the start assisting light source 3 is disposed in contact with or in proximity to the end face 10 of the electrode seal portion 9L. Then, as shown in the dotted chain in FIG. 2, a sleeve-type stopper metal 25 is fitted to the outer circumference of the electrode lead 8 and welded to the electrode lead 8, thereby preventing the pipe member 19 from moving in the direction where the pipe member 19 receding from the end face 10 of the electrode seal portion 9L.

Thus, the start assisting light source 3 can be mounted simply and reliably to a position not being heated to a high temperature upon lighting of the high pressure discharge lamp 1 and capable of efficiently radiating UV-light to the discharge chamber 5 of the lamp 1. Further, since the electrode lead 8 for mounting the start assisting light source 3 is formed of a rigid molybdenum wire having a wire diameter of about 1.2 mm, there is no possibility that the start assisting light source 3 causes positional displacement by an impact if it exerts on the light source device. Further, since the start assisting light source 3 has a simple constitution capable of being mounted to the electrode lead 8 by merely providing the pipe member 19 to the airtight vessel 18 for penetrating the vessel and inserting the electrode lead 8 through the pipe member 19, the manufacturing cost is not increased as well.

In the light source device constituted as described above, when a starting voltage is applied from the lighting circuit 11 of the high pressure discharge lamp 1 to a portion between the electrodes 6R and 6L in the discharge chamber 5, the argon gas filled in the airtight vessel 18 of the start assisting light source 3 is excited to emit UV-light from the airtight vessel 18, and a portion of the UV-light is incident from the end face 10 of the electrode seal portion 9L of the lamp 1 and transmitted in the direction to the discharge chamber 5. Then, the starting gas in the discharge chamber 5 is excited, and tungsten forming the electrodes 6R, 6L emit initial electrons necessary for starting discharge to promote starting of the high pressure discharge lamp 1.

While the start assisting light source 3 can radiate UV-light in a necessary amount also by the constitution described above, an outer electrode 26 comprising a metal plate such as a spring stainless steel sheet of 0.2 mm thickness (SUS 304-CSP) connected to one side of the lighting circuit 11 (on the side electrode 6R) 12R may be disposed near the airtight vessel 18 as shown by a dotted line in FIG. 1, thereby causing discharge for exciting an argon gas in the airtight vessel 18 between the outer electrode 26 and the electrode lead 8 connected to the other side (on the side of electrode 6L) 12L of the lighting circuit 11.

EXAMPLE 2

Figure 4A:
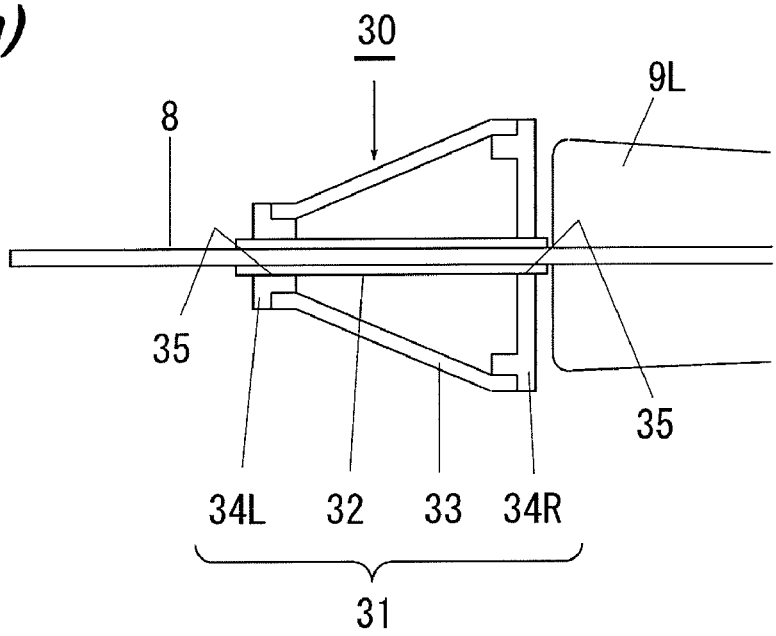
FIG. 4 is a view showing a modified embodiment of a start assisting light source.
Figure 4B:
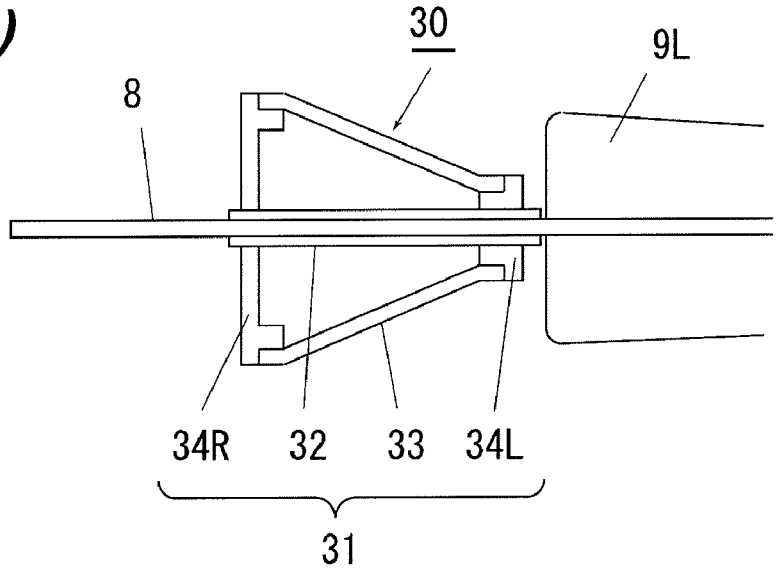

FIG. 4 is a cross sectional view showing a modified example of the start assisting light source. In the start assisting light source 30 shown in the drawing, a pipe member 32 penetrating through the center of the airtight vessel 31 formed of ceramics filled with a rare gas such as an argon gas is provided. The airtight vessel 31 comprises a tapered cylindrical vessel body 33, and a pair of apertured larger and smaller caps 34R, 34L for capping the openings on both ends of the vessel body, and the pipe member 32 is inserted through the apertures 35, 35 of an identical diameter formed at the center of the apertured caps 34R, 34L.

The start assisting light source 30 is mounted to the electrode lead 8 in a state of facing the larger diametrical side of the airtight vessel 31 capped by an apertured cap 34R of a larger size having a size equal with or larger than the end face 10 of the electrode seal portion 9L to the end face 10 of the electrode seal portion 9L and inserting the electrode lead 8 protruding from the end face 10 through the pipe member 32 as shown in FIG. 4(*a*). Alternatively, it is mounted to the electrode lead 8 in a state of facing the smaller diametrical side of the airtight vessel 31 capped by the apertured caps 34L of a smaller size to the end face 10 of the electrode seal portion 9L and inserting the electrode lead 8 protruding from the end face 10 through the pipe member 32 as shown in FIG. 4(*b*). In a case where the start assisting light source 30 is mounted as shown in FIG. 4(*a*), the apertured cap 34R is formed of translucent ceramics and, in a case where the start assisting light source 30 is mounted as shown in FIG. 4(*b*), the tapered cylindrical vessel body 33 and the apertured cap 34L are formed of translucent ceramics.

Then, when the start assisting light source 30 is mounted as shown in FIG. 4(*a*), a portion of UV-light generated in the airtight vessel 31 transmits the apertured larger size cap 34R and is incident efficiently to the end face 10 of the electrode seal portion 9L. When the start assisting light source 30 is mounted as shown in FIG. 4(*b*), since UV-light transmitting the vessel body 33 of the airtight vessel 31 is incident efficiently to the end face 10 of the electrode seal portion 9L, it has an advantage that the amount of UV-light radiated to the discharge chamber 5 of the high pressure discharge lamp 1 is increased more compared with the case of the start assisting light source 3 of Example 1.

EXAMPLE 3

Figure 5A:
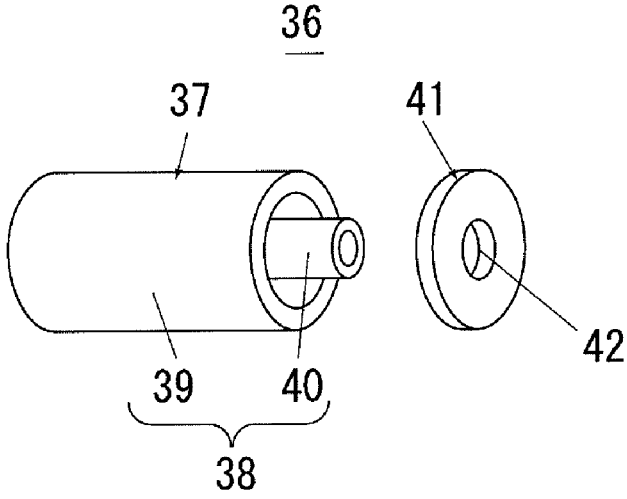
FIG. 5 is a view showing a modified embodiment of a start assisting light source.
Figure 5B:
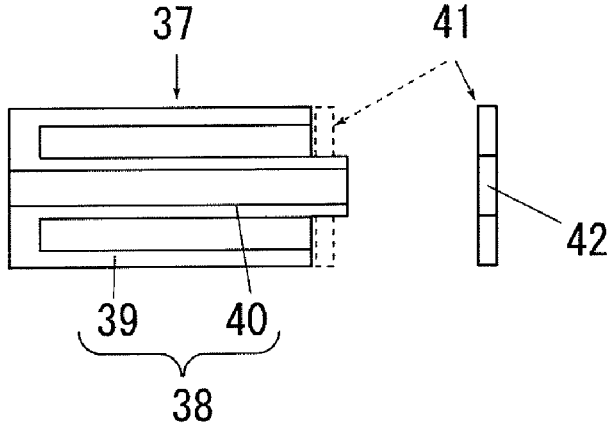

FIG. 5(*a*) is an exploded perspective view showing a modified example of a start assisting light source and FIG. 5(*b*) is a cross sectional view thereof. In the start assisting light source 36 shown in the drawing, an airtight vessel 37 formed of ceramics and filled with a rare gas such as an argon gas is assembled by a vessel body 38 of a double cylindrical structure in which one end of an outer cylinder 39 and one end of an inner cylinder 40 are joined integrally to close one end of the outer cylinder 39 and an apertured cap 41 for capping the opening on the other end of the outer cylinder 39 by fitting the other end of the inner cylinder 40 into an aperture 42. The inner cylinder 40 disposed so as to penetrate through the center of the vessel body 38 constitutes a pipe member for allowing the electrode lead 8 protruding from the end face 10 of the electrode seal portion 9L shown in FIG. 1 to be inserted therethrough.

In the airtight vessel 37, one or both of the vessel body 38 and the apertured cap 41 are formed of translucent ceramics and the vessel is mounted to the electrode lead 8 protruding from the end face 10 such that the portion thereof formed with the translucent ceramics is opposed to the end face 10 of the electrode seal portion 9L shown in FIG. 1, FIG. 2 or FIG. 4. The airtight vessel 37 mounted to the electrode lead 8 is prevented from moving in the direction receding from the end face 10 of the electrode seal portion 9L by the stopper metal 25 as shown in FIG. 2.

Since the start assisting light source 36 of this example requires small number of parts and can be assembled easily, it has an advantage that the manufacturing cost can be decreased remarkably.

EXAMPLE 4

Figure 6A:
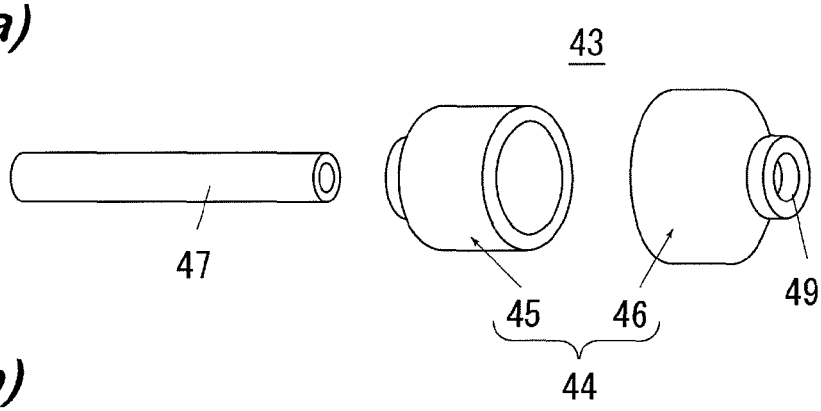
FIG. 6 is a view showing a modified embodiment of a start assisting light source.
Figure 6B:
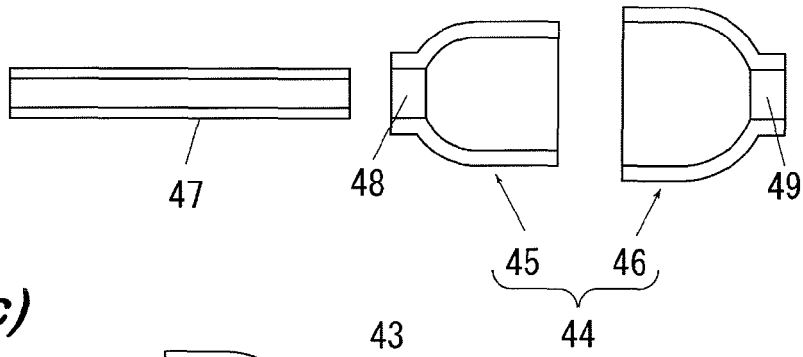
Figure 6C:
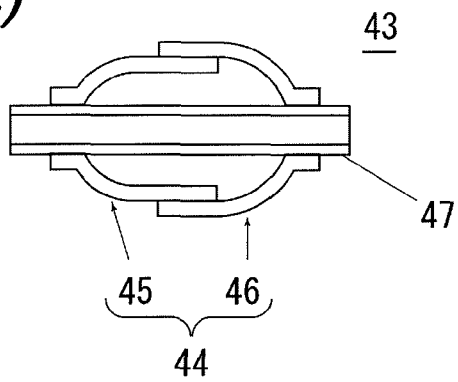
Figure 7:
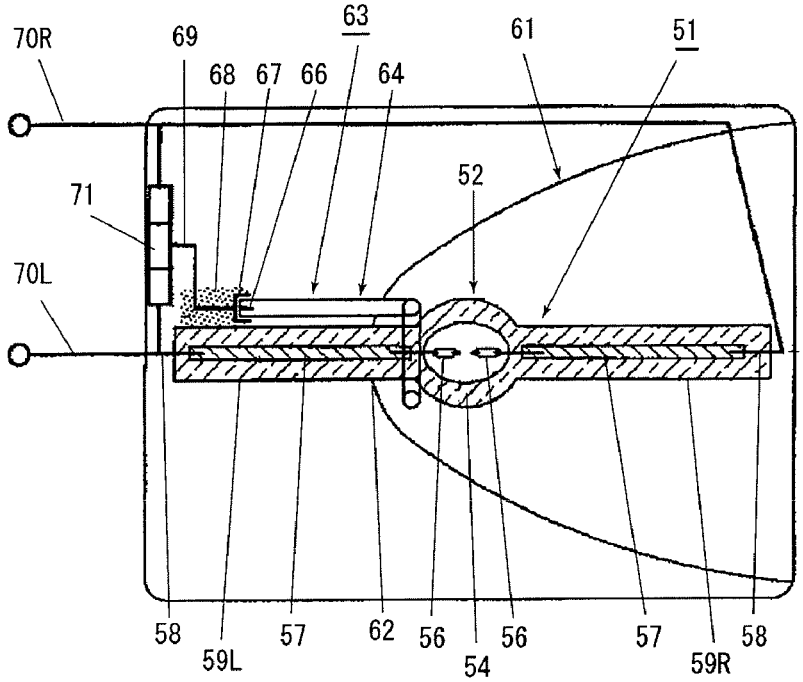
Fig. 7 (Prior Art)
FIG. 7 is a view showing an existent technique for enhancing the starting performance of a high pressure discharge lamp.
Figure 8A:
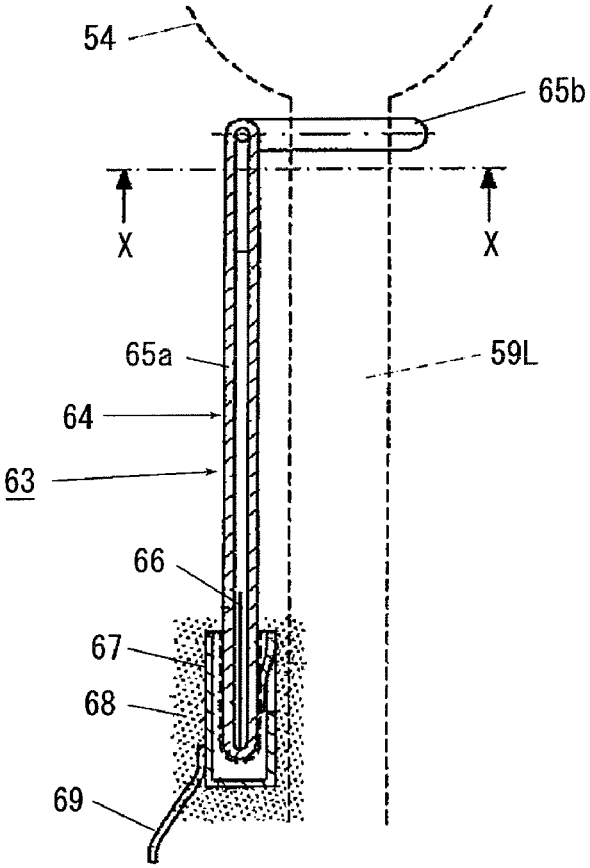
Fig. 8(a) (Prior Art)
FIG. 8 is a view showing an existent technique for enhancing the starting performance of a high pressure discharge lamp.
Figure 8B:
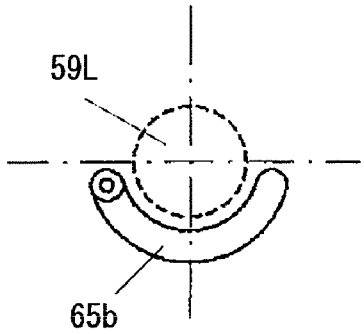
Fig. 8(b) (Prior Art)
Figure 9:
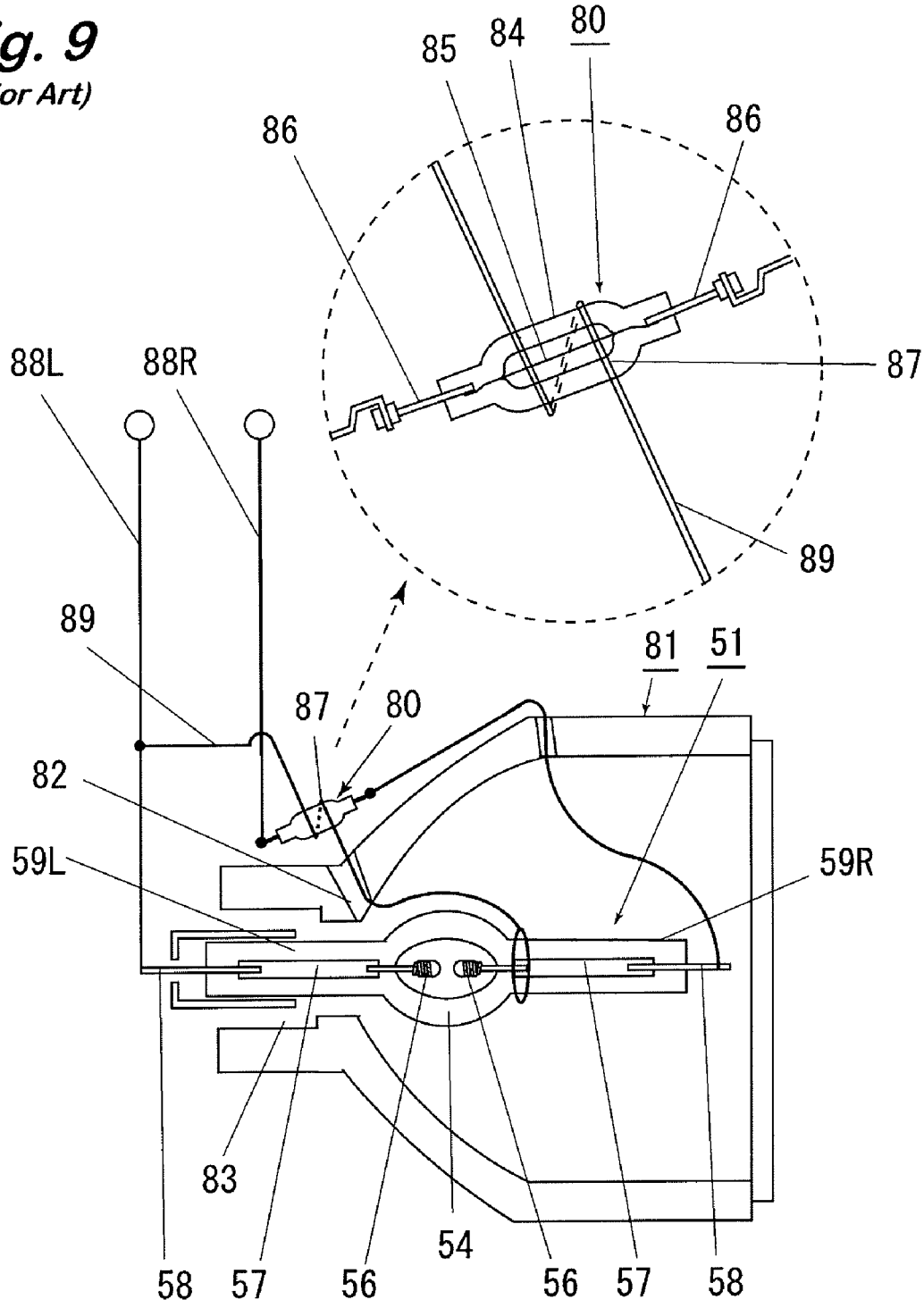
Fig. 9 (Prior Art)
FIG. 9 is a view showing an existent technique for enhancing the starting performance of a high pressure discharge lamp.
Figure 10A:
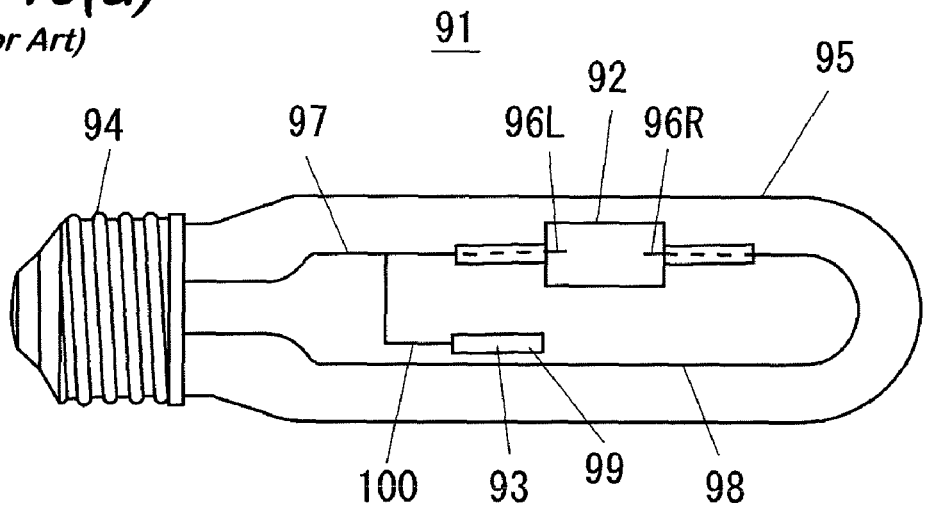
Fig. 10(a) (Prior Art)
FIG. 10 is a view showing an existent technique for enhancing the starting performance of a high pressure discharge lamp.
Figure 10B:
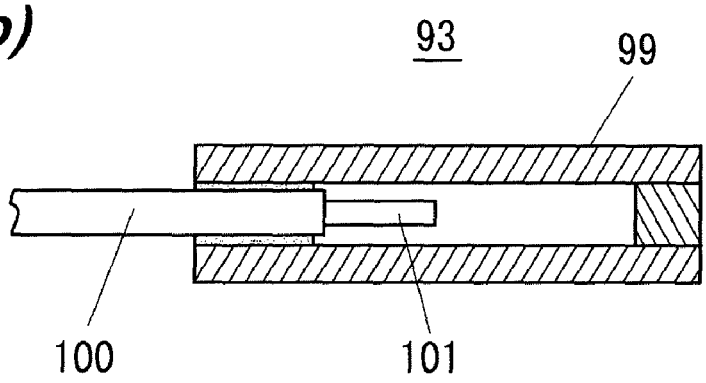
Fig. 10(b) (Prior Art)

FIG. 6(*a*) is an exploded perspective view showing a modified example of a start assisting light source, FIG. 6(*b*) is a cross sectional view thereof, and FIG. 6(*c*) is a cross sectional view showing an assembled state. In a start assisting light source 43 shown in FIG. 6, an airtight vessel 44 formed of ceramics is a capsule type vessel assembled with a body 45 and a cap 46 capped over the body, in which apertures 48, 49 for inserting a pipe member 47 penetrating through the center of the airtight vessel 44 are formed to the body 45 and the cap 46 respectively.

Further, the airtight vessel 44 is formed of translucent ceramics for the portion of the cap 46 and mounted to the electrode lead 8 protruding from the end face 10 so that the portion on the side of the cap 46 is opposed to the end face 10 of the electrode seal portion 9L shown in FIG. 1, FIG. 2, or FIG. 4. The pipe member 47 penetrating through the center of the airtight vessel 44 is formed of a ceramic pipe or a metal pipe such as a niobium pipe. A gap between the body 45 and the cap 46 forming the airtight vessel 44 and a gap formed between the apertures 48, 49 of the body 45 and the cap 46 and the pipe member 47 inserted through the apertures are made airtight by glass frit.

INDUSTRIAL APPLICABILITY

The present invention contributes to the improvement of the starting performance of a high pressure discharge lamp used as a light source for liquid crystal projectors, DLP projectors, etc.

DESCRIPTION OF REFERENCES

1 high pressure discharge lamp
2 concave reflector
3 start assisting light source
4 arc tube
5 discharge chamber
6R electrode
6L electrode
7 metal foil
8 electrode lead
9R electrode seal portion
9L electrode seal portion
10 end face of electrode seal portion
11 lighting circuit
14 bottom hole of concave reflector
18 airtight vessel
19 pipe member
20 vessel body of airtight vessel
21R apertured cap
21L apertured cap
26 outer electrode
30 start assisting light source
31 airtight vessel
32 pipe member
33 vessel body of airtight vessel
34R apertured cap
34L apertured cap
36 start assisting light source
37 airtight vessel
38 vessel body of airtight vessel
39 outer cylinder
40 inner cylinder (pipe member)
41 apertured cap
43 start assisting light source
44 airtight vessel
45 body
46 cap
47 pipe member

The invention claimed is:

1. A light source device including;

a high pressure discharge lamp in which a discharge chamber having a pair of electrodes opposed each other and at least mercury and a starting gas filled therein is formed in the center of an arc tube, a pair of electrode seal portions extend from the discharge chamber to both ends of the arc tube, and connected by way of electrode leads extending from end faces of the electrode seal portions to a lighting circuit, a concave reflector to which the lamp is secured by inserting one electrode seal portion thereof through a bottom hole opened in the bottom of the reflector; and a start assisting light source that radiates UV-light to the discharge chamber for enhancing the starting performance of the lamp upon startup lighting of the lamp, wherein the start assisting light source comprising an airtight vessel formed of ceramics and filled with a rare gas and a pipe member penetrating through the vessel is mounted to the electrode lead protruding from the end face of the one electrode seal portion secured to the bottom hole of the concave reflector by inserting the electrode lead through the pipe member, and the airtight vessel is formed entirely or at a portion opposing the end face of the one electrode seal portion with translucent ceramics.

2. A light source device according to claim 1, wherein the airtight vessel is assembled with a cylindrical vessel body opened at both ends, a pair of apertured caps for capping openings on both ends of the vessel body, and the pipe member fitted into the apertures of both of the caps for closing the apertures thereof.

3. A light source device according to claim 2, wherein the apertured cap opposing the end face of the one electrode seal portion is formed of translucent ceramics.

4. A light source device according to claim 1, wherein the airtight vessel is assembled with a vessel body of a double cylindrical structure in which one end of an outer cylinder and one end of an inner cylinder as the pipe member are joined integrally to close one end of the outer cylinder, and an apertured cap in which the other end of the inner cylinder is fitted into the aperture while capping the opening on the other end of the outer cylinder.

5. A light source device according to claim 1, wherein the airtight vessel comprises a capsule type vessel assembled with a body and a cap capped over the body, in which an aperture for inserting the pipe member is formed in the body and the cap.

6. A light source device according to claim 1, wherein the pipe member comprises a ceramic pipe, in which a stopper metal is welded to the electrode lead inserted through the pipe member for preventing the pipe member from moving in a direction receding from the end face of the one electrode seal portion where the electrode lead protrudes therefrom.

7. A light source device according to claim 1, wherein the pipe member comprises a metal pipe in which the end of the pipe member is welded to the electrode lead inserted through the pipe member.

8. A light source device according to claim 2, wherein the pipe member comprises a ceramic pipe, in which a stopper metal is welded to the electrode lead inserted through the pipe member for preventing the pipe member from moving in a direction receding from the end face of the one electrode seal portion where the electrode lead protrudes therefrom.

9. A light source device according to claim 3, wherein the pipe member comprises a ceramic pipe, in which a stopper metal is welded to the electrode lead inserted through the pipe member for preventing the pipe member from moving in a direction receding from the end face of the one electrode seal portion where the electrode lead protrudes therefrom.

10. A light source device according to claim 4, wherein the pipe member comprises a ceramic pipe, in which a stopper metal is welded to the electrode lead inserted through the pipe member for preventing the pipe member from moving in a direction receding from the end face of the one electrode seal portion where the electrode lead protrudes therefrom.

11. A light source device according to claim 5, wherein the pipe member comprises a ceramic pipe, in which a stopper metal is welded to the electrode lead inserted through the pipe member for preventing the pipe member from moving in a direction receding from the end face of the one electrode seal portion where the electrode lead protrudes therefrom.

12. A light source device according to claim 2, wherein the pipe member comprises a metal pipe in which the end of the pipe member is welded to the electrode lead inserted through the pipe member.

13. A light source device according to claim 3, wherein the pipe member comprises a metal pipe in which the end of the pipe member is welded to the electrode lead inserted through the pipe member.

14. A light source device according to claim 5, wherein the pipe member comprises a metal pipe in which the end of the pipe member is welded to the electrode lead inserted through the pipe member.

* * * * *